US011135490B2

(12) United States Patent
Pippitt

(10) Patent No.: US 11,135,490 B2
(45) Date of Patent: Oct. 5, 2021

(54) HITTING EXTENSION FOR BODY-POSITIONING TRAINER

(71) Applicant: Launch Angle Tee, Inc., Durham, NC (US)

(72) Inventor: Charles James Pippitt, Durham, NC (US)

(73) Assignee: Launch Angle Tee, Inc., Durham, NC (US)

( * ) Notice: Subject to any disclaimer, the term of this patent is extended or adjusted under 35 U.S.C. 154(b) by 0 days.

(21) Appl. No.: 16/702,856

(22) Filed: Dec. 4, 2019

(65) Prior Publication Data

US 2020/0171366 A1 Jun. 4, 2020

Related U.S. Application Data

(60) Provisional application No. 62/775,199, filed on Dec. 4, 2018.

(51) Int. Cl.

*A63B 69/00* (2006.01)
*A63B 59/48* (2015.01)
*A63B 23/02* (2006.01)

(52) U.S. Cl.

CPC ..... *A63B 59/48* (2015.10); *A63B 23/02* (2013.01); *A63B 69/0057* (2013.01); *A63B 2208/0204* (2013.01)

(58) Field of Classification Search

CPC ..... A63B 59/48; A63B 23/02; A63B 69/0057; A63B 69/36; A63B 69/38; A63B 69/0024; A63B 69/0002; A63B 69/3632; A63B 2208/0204

USPC ..... 473/422, 437, 457, 458, 438, 450, 464, 473/257; D21/725, 727, 756–758

See application file for complete search history.

(56) References Cited

U.S. PATENT DOCUMENTS 2,177,970 A * 10/1939 Wettlaufer ..... A63B 53/12 473/316
2,429,351 A * 10/1947 Fetterolf ..... A63B 53/04 473/329
3,109,244 A * 11/1963 Trifaro ..... A63B 69/0057 473/227
3,820,781 A * 6/1974 Kane ..... A63B 23/0211 473/227

(Continued)

OTHER PUBLICATIONS

Launch Angle Tee, Inc. (DBA Baseball Rebellion), "Rebel's Rack." Internet. Avaiable at https://baseballrebellion.com/rebels-rack/. Version of Dec. 4, 2019.

*Primary Examiner* — Mitra Aryanpour
(74) *Attorney, Agent, or Firm* — United IP Counselors, LLC

(57) ABSTRACT

A hitting extension for a body-positioning trainer is disclosed. The hitting extension has an elongate, generally flat body with first and second ends spaced from one another. The second end terminates in a rounded distal edge. A first opening formed in the body proximate to the first end allows the hitting extension to be connected to the body-positioning trainer. The body-positioning trainer restricts the movement of the arms in order to allow the user to focus on torso movement, and the hitting extension allows the user to hit a ball, or another such projectile, using the trainer. Methods for training a user in torso movement using the hitting extension are also disclosed.

5 Claims, 2 Drawing Sheets

(56) References Cited

Figure 1:
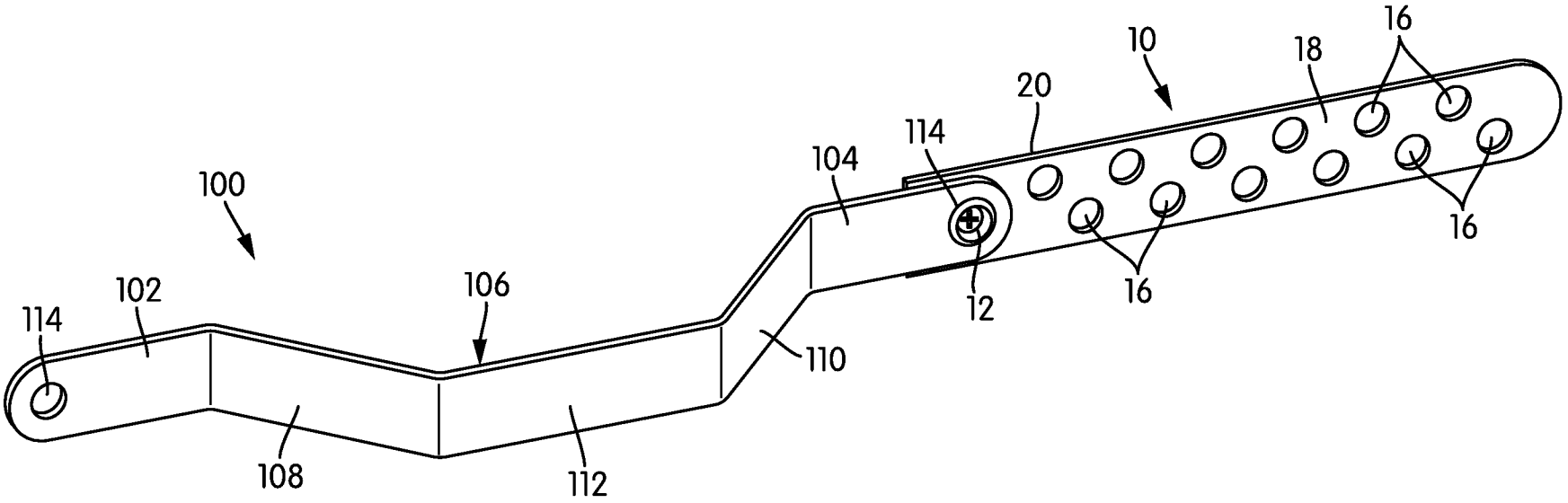

U.S. PATENT DOCUMENTS 4,537,403 A * 8/1985 Farina ..... A63B 60/12 473/203
4,676,502 A * 6/1987 Mahr ..... A63B 21/065 482/105
4,896,887 A * 1/1990 Cable ..... A63B 69/0059 473/212
5,156,401 A * 10/1992 Hodgkiss ..... A63B 69/3632 473/227
5,167,415 A * 12/1992 Iandola ..... A63B 69/3632 473/256
5,203,567 A * 4/1993 Erlinger ..... A63B 69/0059 473/276
5,588,921 A * 12/1996 Parsick ..... A63B 53/14 473/299
5,658,203 A * 8/1997 Shub ..... A63B 69/0059 473/205
5,890,968 A * 4/1999 Mingo ..... A63B 69/0059 473/207
6,129,650 A * 10/2000 Wedge, Jr. ..... A63B 71/0009 482/139
6,267,686 B1 * 7/2001 Legacie, Jr. ..... A63D 15/08 473/44
D464,691 S * 10/2002 Tracy ..... D21/679
6,554,718 B2 * 4/2003 Back ..... A63B 69/0057 473/212
6,887,170 B2 * 5/2005 Stauber ..... A63B 69/0024 473/422
7,041,017 B1 * 5/2006 Carfo ..... A63B 15/00 473/422
7,585,229 B2 * 9/2009 Kelley ..... A63B 69/3608 473/212
7,867,102 B2 * 1/2011 Wallace ..... A63B 21/0552 473/220
D676,912 S * 2/2013 Lee ..... D21/757
8,777,782 B2 * 7/2014 Salomon ..... A63B 69/36 473/457
D752,166 S * 3/2016 Kozac ..... D21/727
D767,055 S * 9/2016 Randle, Sr. ..... D21/725
10,039,968 B2 * 8/2018 Becktell ..... A63B 60/34 473/463
2002/0121742 A1 * 9/2002 Stauber ..... A63B 69/0024 473/422
2003/0220168 A1 * 11/2003 Perry ..... A63B 69/0059 473/276
2004/0033867 A1 * 2/2004 Katami ..... A63B 23/03575 482/109
2009/0191986 A1 * 7/2009 Bohm ..... A63B 69/0002 473/457
2015/0133241 A1 * 5/2015 Mattern ..... A63B 59/50 473/437
2017/0252620 A1 * 9/2017 Becktell ..... A63B 60/06 473/457
2020/0171366 A1 * 6/2020 Pippitt ..... A63B 69/0057 473/458

* cited by examiner

HITTING EXTENSION FOR BODY-POSITIONING TRAINER

CROSS-REFERENCE TO RELATED APPLICATIONS

This application claims priority to U.S. Provisional Patent Application No. 62/775,199, filed Dec. 4, 2018, the contents of which are incorporated by reference herein in their entirety.

BACKGROUND OF THE INVENTION

1. Field of the Invention

The invention relates to sports training and exercise equipment, and in particular, to a hitting extension for a body positioning trainer.

2. Description of Related Art

In baseball and softball, a batter hits the ball with a bat. Simple as that action may be to describe, the movements behind the action are complex, and training someone to perform them correctly is even more complex and difficult. Improving body positioning and equipment technique can improve performance in virtually all sports. In baseball and softball, for example, learning proper body positioning through swing can improve virtually any batter's hitting to some extent.

Various forms of training aids exist to teach both amateurs and professionals proper body positioning and equipment technique for various sports. These training aids vary considerably in form and function. One training aid, sold as THE REBEL'S RACK™ by Baseball Rebellion (Durham, N.C., United States), is a swing training aid for baseball, softball, tennis, and other sports that use an upper both swing. Holding this device in place against the both constrains the movement of the arms and encourages proper body positioning while the athlete practices his/her swing. Additionally, the device is adapted to be connected to a resistance training system that may reinforce correct movement and strengthen the body during the movement.

SUMMARY OF THE INVENTION

One aspect of the invention relates to a hitting extension for a body-positioning trainer. The hitting extension has an elongate, generally flat body with first and second ends spaced from one another. The second end terminates in a rounded distal edge. A first opening formed in the body proximate to the first end allows the hitting extension to be connected to the body-positioning trainer.

Another aspect of the invention relates to the combination of a hitting extension, as described above, and a body-positioning trainer.

Yet another aspect of the invention relates to methods for training a body movement. The methods involve causing or allowing a user to hit one or more projectiles using a device that restricts the movement of the arms and forces the user to move the torso in order to hit the one or more projectiles. The device may include a hitting extension, as described above, in order to hit the one or more projectiles. In some cases, resistance may be used. The projectiles may be balls.

Other aspects, features, and advantages will be set forth in the description that follows.

BRIEF DESCRIPTION OF THE DRAWING FIGURES

Figure 2:
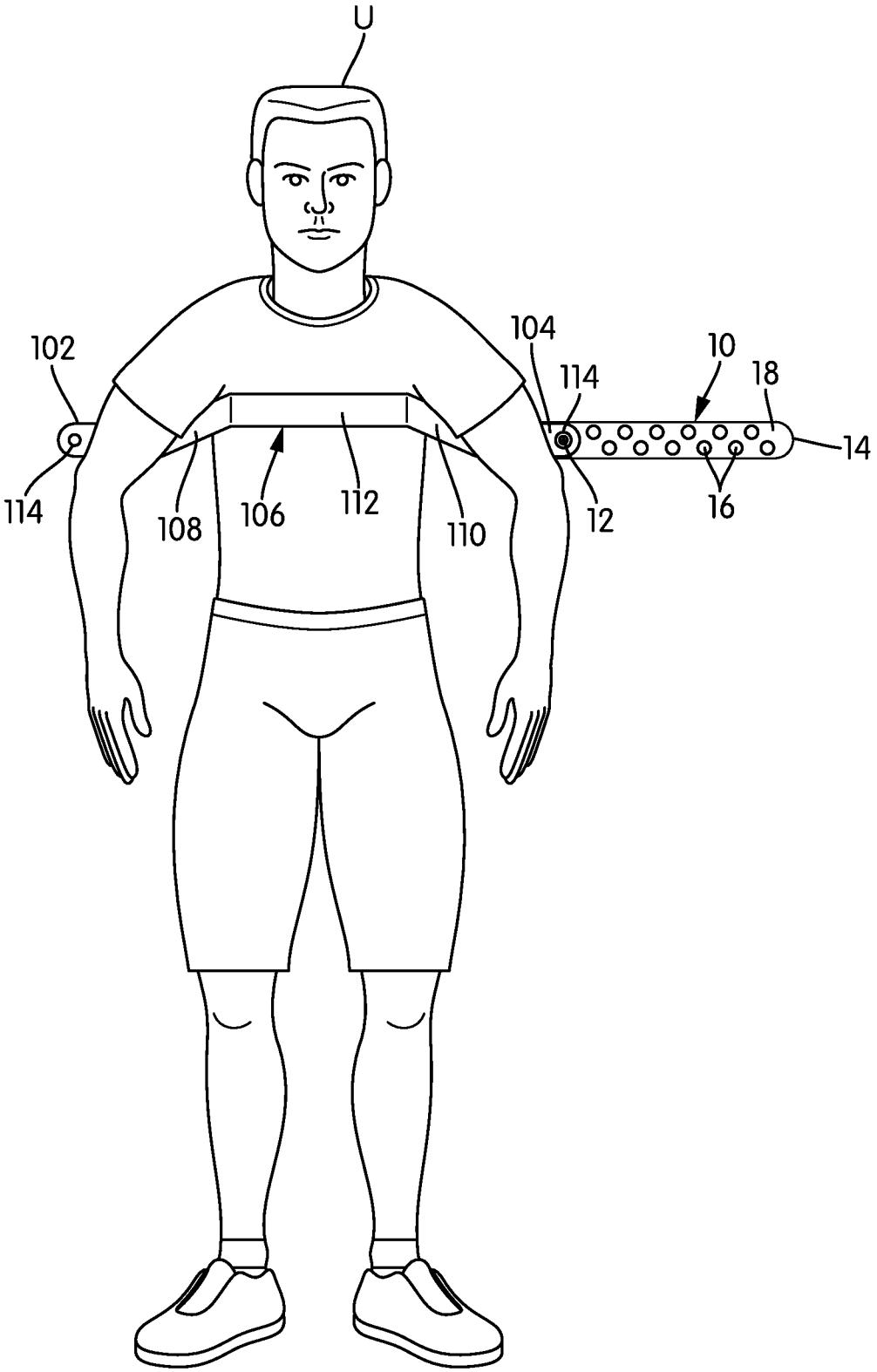

The invention will be described with respect to the following drawing figures, in which like numerals represent like elements throughout the figures, and in which:

FIG. 1 is a perspective view of a body-positioning trainer with a hitting extension according to one embodiment of the invention; and FIG. 2 is a perspective view of the body-positioning trainer with the hitting extension of FIG. 1 in use.

DETAILED DESCRIPTION

FIG. 1 is a perspective view of a hitting extension, generally indicated at 10, according to one embodiment of the invention. The hitting extension 10 is shown mounted on a body-positioning trainer, generally indicated at 100. FIG. 2 is a perspective view of the trainer 100 and hitting extension 10 in use.

The trainer 100 is an elongate, segmented member with a long axis that extends along its length. The trainer 100 has a first side flange 102, a second side flange 104, and a central portion 106. The first and second flanges 102, 104 are at least generally flat and are in the same or substantially the same plane—in other words, they are aligned with one another. The central portion 106 extends outward and away from the first and second flanges 102, 104. In the illustrated embodiment, the central portion 106 has three segments: a first angled segment 108 that defines an acute angle with respect to the plane of the first and second flanges 102, 104, a second angled segment 110 with a slope opposite to the slope of the first angled segment 108, and a central segment 112 between the two angled segments 108, 112. The central segment 112 extends substantially parallel to the first and second flanges 102, 104.

In essence, the central portion 106 takes a trapezoidal shape as it extends away from the first and second flanges 102, 104. However, the central portion 106 may be a U-shape or some other shape in other embodiments. As shown in FIG. 2, in use, a user U places the central portion 106 of the trainer 100 against the front of the chest, high on the torso. The first and second flanges 102, 104 insert behind the arms, and when the arms are held close to the torso, the trainer 100 is held in place. Holding the trainer 100 in position against the upper part of the chest constrains the movement of the user's arms. In the position shown in FIG. 2, the user's arms are farther from the torso than they might be in use, in order to show the details of the trainer's positioning.

The trainer 100 includes a set of openings 114, one in each flange 102, 104. These openings 114 can be used to attach the trainer 100 to a set of resistance bands or any number of other accessories.

In the embodiment of FIGS. 1 and 2, the hitting extension 10 is rigidly connected to the trainer 100 by way of a fastener set 12 inserted into one of the openings 114, through both the trainer 100 and the hitting extension 10. In the illustrated embodiment, the fastener set 12 comprises a bolt and corresponding nut, although other types of fasteners may be used. In some cases, a washer may be inserted into the opening 114 in order to fill space so as to secure a smaller fastener 12 in the larger opening 114.

The hitting extension 10 allows the user U to hit balls, such as tennis balls, whiffle balls and soft or compressible balls while using the trainer 100. In some cases, baseballs and softballs may be used, although it may be more advantageous to use the other types of balls for training purposes. However, with the motion of the arms constrained by the trainer 100, the user U moves the hitting extension 10 into position and hits primarily by moving the torso. This allows the user U to hit while focusing on proper movement of the torso, without using the arms, wrists, or hands. The force of the hitting extension 10 connecting with a ball may serve to strengthen the muscles and acclimate the user U to the forces generated during such a movement—those forces typically being different than the kinds of forces that are generated by a resistance band.

The hitting extension 10 itself is a generally flat bar that extends outwardly from one side of the trainer 100, in this case from the second flange 104 of the trainer 100. In the illustrated embodiment, the hitting extension 10 has the same or essentially the same width as the trainer 100 on which it is intended to be mounted, although in some cases it may be at least slightly wider. While not shown in the views of FIGS. 1 and 2, the hitting extension 10 has a corresponding opening to receive the fastener set 12 that secures the hitting extension to the trainer 100.

The fastener set 12 is secured tightly enough to prevent rotation of the hitting extension 10 relative to the trainer 100, and to keep it in the straight, linear position shown in FIG. 1. However, there may be situations in which a user U might wish to secure the hitting extension 10 in a different rotational position with respect to the trainer 100.

As can be seen particularly in FIG. 1, there is a substantial overlap between the hitting extension 10 and the second flange 104. In one embodiment, that overlap may be on the order of several inches. The overlap may help to reinforce and stabilize the hitting extension 10 by improving the ability of the hitting extension to resist impulse and bending forces that are generated when the hitting extension strikes a ball.

In the illustrated embodiment, the extension is about 24 inches (61 cm) in overall length, 2.25 inches (5.7 cm) in width, and 0.25 inches (0.64 cm) thick. The distal edge 14 of the hitting extension 10 is rounded, primarily for safety. The radius of curvature may be, e.g., 0.125 inches (0.3175 cm), but that radius of curvature is not critical and may vary from embodiment to embodiment. Similarly, other edges and corners of the hitting extension 10 may be rounded, beveled, chamfered, or otherwise modified in order to reduce any safety risk that they might otherwise pose.

Along substantially the entirety of its length, the hitting extension 10 has a series of perforations 16. In the illustrated embodiment, there are twelve of these perforations 16 arranged in two staggered rows of six, with each perforation 16 having a diameter of 0.5 inches (1.3 cm). However, the number and size of perforations 16 is not critical, and there may be more or fewer in other embodiments, so long as the hitting extension 16 remains stiff enough to hit a ball effectively. In general, the perforations 16 are provided in order to reduce the weight of the hitting extension 10, and, potentially, to reduce its air resistance during swing. While perforations 16 may be advantageous for those reasons, they may also be omitted in some embodiments.

The forward face 18 of the hitting extension is generally flat and planar, as is the opposite rear face 20, although either face may have a contour in particular embodiments.

Typically, the hitting extension 10 would be made of a metal, such as steel or aluminum, although other materials, like wood, plastics, and synthetic fiber-composites, may also be used in some cases. Generally speaking, the hitting extension 10 may be machined out of bulk material, made out of sheet metal, cast, molded, or fabricated with any other known process. There is no requirement that the trainer 100 and the hitting extension 10 be made of the same material, although it may be convenient to do so. For example, the trainer 100 and the hitting extension 10 may both be made of sheet steel of the same or nearly the same thickness. Alternatively, the trainer 100 may be made of steel and the hitting extension 10 may be made of another material, such as aluminum. In that case, the aluminum hitting extension 10 may be made somewhat thicker than the steel trainer 100, so that the two have roughly the same functional stiffness. Typically, both the trainer 100 and the hitting extension 10 will be anodized, but they may also be surface treated in other ways, including by painting, powder-coating, or other such processes.

As used here, the terms "rigid" and "rigidly" refer to a connection between the trainer 100 and the hitting extension 10 that allows the two joined elements 10, 100 to act as a single piece and that will not loosen with ordinary use of the trainer 100 and the hitting extension 10 to hit balls. The term "stiff" refers primarily to the tendency of a material to bend or break in response to a force. A hitting extension 10 is sufficiently stiff, as that term is used here, if an ordinary hit of a ball by a typical athlete does not cause permanent deflection (i.e., bending) or breakage of the hitting extension 10.

The hitting extension 10 of the illustrated embodiment is broad and flat, which may make it easier for a user U to hit a ball with it. However, the shape shown in the figures is not the only possible shape for a hitting extension. In some embodiments, the width, shape, or other characteristics may more closely match the characteristics of the hitting device that would normally be used in the sport in question. For example, a hitting extension in another embodiment could have the width and at least some of the typical curvature of a baseball or softball bat, a cricket bat, etc. This may also provide an added level of difficulty for the user.

While the hitting extension 10 is shown as being used with the trainer 100 shown in the figures, the extension 10 is not limited to being used with any particular trainer 100 or base. Rather, the extension 10 may be useful with any kind of trainer, and in particular, any kind of trainer that restricts the movement of the arms and forces the user to focus on torso movement. Additionally, as was noted above, the trainer 100 shown in the figures can be used with a series of elastic resistance bands which are coupled to it via the holes 114 at its ends. These bands may be used with the trainer 100 when the extension is installed.

Although certain portions of this description focus on the structure of the hitting extension 10 itself, and on its installation on the trainer 100, other aspects of the invention relate to methods for training users in proper body movements and swing mechanics using trainers and hitting extensions such as those described here. These methods will typically involve restricting the movement of the user's arms using either the trainer 100 or another such device, and directing or allowing a trainee to hit projectiles, such as balls, using the extension 10 by moving the torso to move the extension 10. As was described above, the trainee may be directed to perform the hitting exercise under resistance. Resistance may be provided in a variety of ways, ranging from connecting resistance bands to the trainer 100, providing body blocking or resistance using another device, or even manually providing resistance by pushing back against the torso, or against particular muscle groups, during swing. The trainee may be directed, for example, to perform training exercises in sets, swinging a certain number of times per set. The difficulty of the exercise may be increased by increasing resistance, if resistance is used, or by other mechanisms, like forcing the trainee to hit a heavier ball or a ball of a different size, or by measuring the characteristics of the ball's movement after it is hit and encouraging the user to improve those characteristics, such as the distance the ball travels after it is hit, or the direction in which it travels.

The extension 10 may also be used as a part of body conditioning or rehabilitative exercise, with the goal being to improve biomechanics and strength either selectively in certain muscle groups or throughout the upper body. The method of use and methods of training in body conditioning and rehabilitative situations will often be roughly the same as those used for swing training, but the metrics and goals may be different. Training sessions may be recorded on video for later analysis, and if desired, the extension 10 may bear markers or sensors to record its position, velocity, acceleration, and other such metrics.

While the invention has been described with respect to certain embodiments, the description is intended to be exemplary, rather than limiting. Modifications and changes may be made within the scope of the invention, which is defined by the appended claims.

What is claimed is:

1. In combination:

a body-positioning trainer including an elongate body having first and second flanges arranged to be substantially aligned with one another and to extend in the same plane as one another, at least one of the first and second flanges having a first opening proximate to an end thereof, and a central section between the first and second flanges, the central section extending outwardly from the first and second flanges;

a hitting extension having an elongate, generally flat body having first and second ends spaced from one another, the second end terminating in a rounded distal edge, and a second opening formed in the body of the hitting extension proximate to the first end; and a fastener passing through the first opening and the second opening so as to rigidly connect the body-positioning trainer and the hitting extension, the fastener adapted to hold the hitting extension at different rotational positions with respect to the body-positioning trainer.

2. The combination of claim 1, wherein the body-positioning trainer and the hitting extension are aligned with one another such that the hitting extension extends straight from the body-positioning trainer.

3. The combination of claim 1, the hitting extension further comprising a plurality of perforations spaced from one another along a length of the body of the hitting extension.

4. The combination of claim 3, wherein the plurality of perforations comprise staggered rows of perforations.

5. The combination of claim 1, wherein the hitting extension is comprised of metal.

* * * * *